US009825354B2

(12) United States Patent
Hu et al.

(10) Patent No.: US 9,825,354 B2
(45) Date of Patent: Nov. 21, 2017

(54) RECONFIGURABLE MIMO ANTENNA FOR VEHICLES

(71) Applicant: The University of Birmingham, Birmingham (GB)

(72) Inventors: Zhen Hua Hu, Birmingham (GB); Peter Hall, Birmingham (GB); Peter Gardner, Birmingham (GB)

(73) Assignee: Smart Antenna Technologies Ltd., Birmingham (GB)

( * ) Notice: Subject to any disclaimer, the term of this patent is extended or adjusted under 35 U.S.C. 154(b) by 0 days.

(21) Appl. No.: 14/439,131

(22) PCT Filed: Oct. 31, 2013

(86) PCT No.: PCT/GB2013/052838

§ 371 (c)(1),
(2) Date: Apr. 28, 2015

(87) PCT Pub. No.: WO2014/072683

PCT Pub. Date: May 15, 2014

(65) Prior Publication Data

US 2015/0311582 A1 Oct. 29, 2015

(30) Foreign Application Priority Data

Nov. 9, 2012 (GB) ..... 1220236.2

(51) Int. Cl.
*H01Q 21/00* (2006.01)
*H01Q 1/27* (2006.01)
(Continued)

(52) U.S. Cl.
CPC ..... *H01Q 1/27* (2013.01); *H01Q 1/241* (2013.01); *H01Q 1/32* (2013.01); *H01Q 1/3275* (2013.01); *H01Q 9/16* (2013.01); *H01Q 21/28* (2013.01)

(58) Field of Classification Search
CPC ..... H01Q 1/241; H01Q 1/3275; H01Q 1/27; H01Q 9/16; H01Q 21/28
(Continued)

(56) References Cited

U.S. PATENT DOCUMENTS 5,300,936 A * 4/1994 Izadian ..... H01Q 1/32 343/700 MS
6,175,334 B1 1/2001 Vannatta et al.
(Continued)

FOREIGN PATENT DOCUMENTS

CN 1207004 A 2/1999
CN 101072061 A 11/2007
(Continued)

OTHER PUBLICATIONS

International Search Report and Written Opinion for corresponding PCT Application No. PCT/GB2013/052838, dated Jan. 27, 2014 (8 pgs.).
(Continued)

*Primary Examiner* — Khai M Nguyen
(74) *Attorney, Agent, or Firm* — Shumaker & Sieffert, P.A.

(57) ABSTRACT

The present invention discloses are configurable MIMO (Multiple-Input Multiple-Output) antenna for vehicles. The antenna comprises a balanced antenna and an unbalanced antenna mounted on a supporting substrate. Both the balanced antenna and the unbalanced antenna are located towards the same end of the substrate and the substrate comprises a substantially triangular planar element.

22 Claims, 12 Drawing Sheets

(51) Int. Cl.

| | |
|---|---|
| ***H01Q 1/24*** | (2006.01) |
| ***H01Q 1/32*** | (2006.01) |
| ***H01Q 9/16*** | (2006.01) |
| ***H01Q 21/28*** | (2006.01) |

(58) Field of Classification Search
USPC ..... 343/713, 727, 872, 700 MS, 702
See application file for complete search history.

(56) References Cited

U.S. PATENT DOCUMENTS

| | | | | |
|---|---|---|---|---|
| 6,329,954 | B1 | 12/2001 | Fuchs et al. | |
| 6,879,294 | B2 | 4/2005 | Yuanzhu | |
| 6,909,401 | B2 * | 6/2005 | Rutfors | H01Q 1/243 343/700 MS |
| 7,239,281 | B2 * | 7/2007 | Lu | H01Q 1/3275 343/711 |
| 7,408,511 | B2 | 8/2008 | Liu | |
| 7,492,318 | B2 * | 2/2009 | Duzdar | H01Q 1/3275 343/711 |
| 9,190,719 | B2 | 11/2015 | Kerselaers | |
| 9,379,430 | B2 | 6/2016 | Kerselaers | |
| 2003/0137463 | A1 | 7/2003 | Shimizu | |
| 2006/0227057 | A1 | 10/2006 | Lu | |
| 2007/0024513 | A1 | 2/2007 | Sako | |
| 2007/0176829 | A1 | 8/2007 | Liu | |
| 2008/0287084 | A1 | 11/2008 | Krebs et al. | |
| 2009/0109104 | A1 * | 4/2009 | Ide | H01Q 1/243 343/730 |
| 2010/0220022 | A1 | 9/2010 | Yoon et al. | |
| 2010/0265145 | A1 | 10/2010 | Chung | |
| 2011/0221640 | A1 * | 9/2011 | Huber | H01Q 1/1214 343/713 |
| 2012/0001811 | A1 * | 1/2012 | Yoo | H01Q 1/3275 343/713 |
| 2015/0311582 | A1 | 10/2015 | Hu et al. | |

FOREIGN PATENT DOCUMENTS

| | | | |
|---|---|---|---|
| CN | 102655266 | A | 9/2012 |
| CN | 102655267 | A | 9/2012 |
| CN | 104769772 | A | 7/2015 |
| DE | 20314442 | U1 | 11/2003 |
| EP | 1772930 | A1 | 11/2007 |
| EP | 2348576 | A1 | 7/2011 |
| EP | 2479839 | A1 | 7/2012 |
| GB | 2422723 | A | 8/2006 |
| WO | 9966595 | A1 | 6/1999 |
| WO | 2011124636 | A1 | 10/2011 |
| WO | 2012072969 | A1 | 6/2012 |

OTHER PUBLICATIONS

Response to Office Action dated Nov. 16, 2016, from U.S. Appl. No. 14/417,481, filed Feb. 16, 2017, 12 pp.
Notification of the First Office Action for CN Application No. 201380040774.0, dated Jun. 8, 2016, 9 pp.
Notification of the Second Office Action for CN Application No. 201380040774.0, dated Jan. 10, 2017, 15 pp.
Examination Report from counterpart Application No. GB1220236.2, dated Jul. 21, 2015, 3 pp.
International Search Report and Written Opinion for corresponding PCT Application No. PCT/GB2013/051855, dated Sep. 10, 2013 (11 pgs.).
Notification of the First Office Action, and translation thereof, from counterpart Chinese Application No. 201380058388.4, dated Jun. 22, 2016, 12 pp.
Office Action from U.S. Appl. No. 14/417,481, dated Nov. 16, 2016, 15 pp.
Wallace, "Antenna Selection Guide," Application Note AN058, Texas Instruments, Oct. 5, 2010, 45 pp.
Bernhard, "Reconfigurable Antennas," Synthesis Lectures on Antennas, Lecture #4, published online Nov. 26, 2007, 74 pp.
Search Report from counterpart Chinese Application No. 201380058388.4, dated Jun. 14, 2016, 3 pp.
Final Office Action from U.S. Appl. No. 14/417,481, dated Jun. 2, 2017, 15 pp.
Advisory Action from U.S. Appl. No. 14/417,481, dated Sep. 22, 2017 4 pp.
Request for Continued Examination (RCE) and Response to Final Office Action and Advisory Action from U.S. Appl. No. 14/417,481, dated Oct. 12, 2017, 14 pp.

* cited by examiner

RECONFIGURABLE MIMO ANTENNA FOR VEHICLES

This application is a national stage application under 35 U.S.C. §371 of PCT Application No. PCT/GB2013/052838, filed Oct. 31, 2013, which claims the benefit of Great Britain Application No. 1220236.2, filed Nov. 9, 2012. The entire contents of each of PCT Application No. PCT/GB2013/052838 and Great Britain Application No. 1220236.2 are incorporated herein by reference in their entirety.

FIELD OF THE INVENTION

The invention relates to a reconfigurable MIMO (Multiple-Input Multiple-Output) antenna for vehicles. Particularly, but not exclusively, the invention relates to a reconfigurable MIMO antenna for mounting on a vehicle roof.

BACKGROUND TO THE INVENTION

Multiple-input multiple-output (MIMO) wireless systems exploiting multiple antennas as both transmitters and receivers have attracted increasing interest due to their potential for increased capacity in rich multipath environments. Such systems can be used to enable enhanced communication performance (i.e. improved signal quality and reliability) by use of multi-path propagation without additional spectrum requirements. This has been a well-known and well-used solution to achieve high data rate communications in relation to 2G and 3G communication standards. For indoor wireless applications such as router devices, external dipole and monopole antennas are widely used. In this instance, high-gain, omni-directional dipole arrays and collinear antennas are most popular. For outdoor mobile devices, such as automobile roof antenna systems, rod antennas, film antennas, and PIFAs (Planar Inverted F-type Antennas) are extremely popular. However, very few portable devices with MIMO capability are available in the marketplace. The main reason for this is that, when gathering several radiators in a portable device, the small allocated space for the antenna limits the ability to provide adequate isolation between each radiator.

The challenges for vehicle mounted MIMO antennas for 4G LTE (long term evolution) systems are even greater due partly to the new shapes of the antenna that are desired (such as 'shark-fin' antennas and conformal planar roof mounted antennas), and partly to the higher performance requirements, with the most demanding being a need for at least 20 dB of isolation between the operating bands. According to the latest LTE MIMO antenna requirements, the LTE hardware device shall support one transmitter and two receivers for LTE 3G, with operation over 13 bands. More specifically, the device shall have a primary antenna (PA) for transmit and receive functions and a secondary antenna (SA) for MIMO/receive diversity functions.

The applicants have described a first reconfigurable MIMO antenna in WO2012/072969. An embodiment is described in which the antenna comprises a balanced antenna located at a first end of a PCB and a two-port chassis-antenna located at an opposite second end of the PCB. However, in certain applications this configuration may not be ideal or even practical since it requires two separate areas in which to locate each antenna. However, this spacing was chosen to provide adequate isolation between each antenna structure.

An aim of the present invention is therefore to provide a reconfigurable MIMO (Multiple-Input Multiple-Output) antenna for vehicles which helps to address the above-mentioned problems.

SUMMARY OF THE INVENTION

According to a first aspect of the present invention there is provided a reconfigurable MIMO (Multiple-Input Multiple-Output) antenna for vehicles comprising: a balanced antenna and an unbalanced antenna mounted on a supporting substrate; wherein both the balanced antenna and the unbalanced antenna are located towards the same end of the substrate and wherein the substrate comprises a substantially triangular planar element.

Embodiments of the invention therefore provide a reconfigurable antenna which can be located at one end of a substantially triangular supporting substrate (e.g. PCB) and which is therefore easily integrated into any conventional roof-mounted vehicle antenna housing, such as a 'shark-fin' design. The antenna itself may have a small, low profile and be relatively cheap to manufacture, for example, when compared to the reconfigurable MIMO antenna in WO2012/072969. The antenna may also offer high performance (i.e. good efficiency and gain), a wide frequency covering range and high isolation between each radiator.

The unbalanced antenna may be mounted such that it extends substantially perpendicularly to the triangular planar element. In which case, the unbalanced antenna may be provided on a second substrate extending substantially perpendicularly to the triangular planar element. The second substrate may be in the shape of a quarter-ellipse having a curved top surface and a perpendicular end surface, which is located towards the same end of the substrate as the balanced antenna.

Alternatively, the unbalanced antenna may be mounted such that it extends substantially parallel to the triangular planar element.

The unbalanced antenna may be located substantially centrally of the balanced antenna.

The triangular planar element may comprise a base and two sides which are substantially equal in length.

The balanced antenna and the unbalanced antenna may be located towards the base of the triangular planar element.

The substrate may further comprise a substantially rectangular planar element located adjacent the base of the triangular planar element.

The balanced antenna may comprise two symmetrically arranged arms. Each arm may comprise an inwardly facing L-shaped planar element. In particular embodiments, each arm may be bracket-shaped (e.g. with each arm having at least one perpendicular element). Alternatively, the balanced antenna may be constituted by a printed dipole.

Where each arm comprises inwardly facing L-shaped planar elements, the L-shaped elements may conform to the shape of the substrate. For example, when the balanced antenna is provided on the rectangular planar element, the L-shaped elements will each have an internal angle of 90 degrees. However, when the balanced antenna is provided on the triangular planar element, the L-shaped elements will each have an internal angle of less than 90 degrees.

The balanced antenna and/or the unbalanced antenna may be non-resonant. For example, the unbalanced antenna may comprise a non-resonant element which is fed against a ground plane formed by or on the substrate or the second substrate. By contrast the balanced antenna may be fed against itself.

The antenna may further comprise one or more matching circuits arranged to tune the balanced antenna and/or the unbalanced antenna to a desired operating frequency. For example, the antenna may be configured to cover one or more of: DVB-H, GSM710, GSM850, GSM900, GSM1800, PCS1900, SDARS, GPS1575, UMTS2100, Wifi, Bluetooth, LTE, LTA and 4G frequency bands.

In certain embodiments, the unbalanced antenna (e.g. non-resonant element) may be located adjacent to; at least partially enclosed by; within the footprint of; or transversely aligned with at least a portion of the balanced antenna.

The balanced antenna and the unbalanced antenna may be provided with substantially centrally located feed lines. This is advantageous in ensuring that the antenna has high performance.

The supporting substrate and the second substrate may be constituted by printed circuit boards (PCBs).

The unbalanced antenna may comprise at least a portion which is etched onto the substrate. Alternatively, the unbalanced antenna may comprise at least a portion which is provided on a separate structure (e.g. the second substrate) which is attached to the substrate.

The shape and configuration of the unbalanced antenna is not particularly limited and may be designed for a specific application and/or desired performance criteria. Similarly, the shape and configuration of the balanced antenna is not particularly limited and may be designed for a specific application and/or desired performance criteria.

In one embodiment, the unbalanced antenna may be rectangular. In another embodiment the unbalanced antenna may be bracket-shaped, for example, having a first element substantially parallel to the substrate (or second substrate) and a second element substantially perpendicular to the substrate (or second substrate).

The balanced antenna may be located above the substrate or around (i.e. outside of) the substrate. In certain embodiments, the substrate may comprise a cut-out located beneath the balanced antenna.

The balanced antenna and the unbalanced antenna may be provided on opposite surfaces of the substrate (although still at the same end thereof). In certain embodiments, the balanced antenna and the unbalanced antenna may be transversely separated by the thickness of the substrate alone.

The substrate (or second substrate) may have a ground plane printed on a first surface thereof. The unbalanced antenna also may be provided on the first surface and may be spaced from the ground plane by a gap.

Multiple matching circuits may be provided for each of the balanced antenna and the unbalanced antenna. Different modes of operation may be available by selecting different matching circuits for the balanced antenna and/or the unbalanced antenna. Switches may be provided to select the desired matching circuits for a particular mode of operation (i.e. a particular frequency band or bands).

Each matching circuit may comprise at least one variable capacitor to tune the frequency of the associated balanced antenna or unbalanced antenna over a particular frequency range. The variable capacitor may be constituted by multiple fixed capacitors with switches, varactors or MEMS capacitors.

The matching circuits associated with the unbalanced antenna may be coupled to a first signal port and the matching circuits associated with the balanced antenna may be coupled to a second signal port.

Each signal port and/or matching circuit may be associated with a different polarisation. For example, a 90 degree phase difference may be provided between each port/matching circuit at a desired operating frequency.

The antenna may further comprising a control system which is connected to each port and which comprises a control means for selecting a desired operating mode.

The substrate may be of any convenient size and in one embodiment may have a surface area of approximately $0.5\times100\times50$ mm$^2$ so that it can easily be accommodated in a conventional roof-mounted vehicle antenna housing. It will be understood that the thickness of the substrate is not limited but will typically be a few millimeters thick (e.g. 1 mm, 1.5 mm, 2 mm or 2.5 mm).

The reconfigurable antenna of the present invention may be configured as a roof-mounted vehicle antenna.

BRIEF DESCRIPTION OF THE DRAWINGS

Certain embodiments of the present invention will now be described with reference to the accompanying drawings in which.

DETAILED DESCRIPTION OF CERTAIN EMBODIMENTS

Figure 1A:
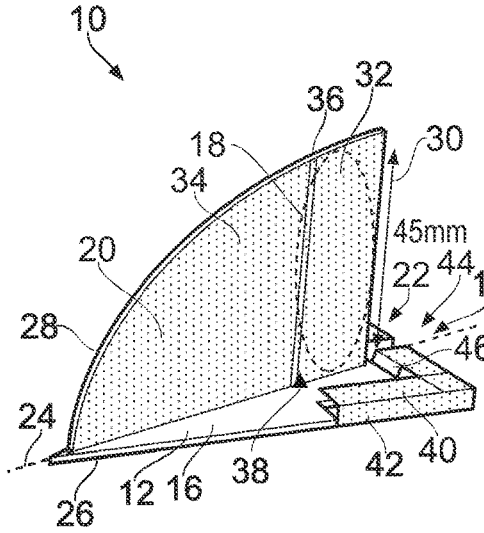
FIG. 1A shows a top side perspective view of an antenna according to a first embodiment of the present invention.
Figure 1B:
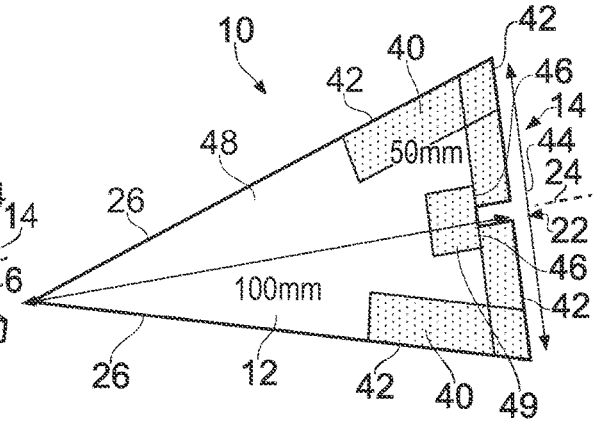
FIG. 1B shows an underside view of the antenna shown in FIG. 1A.
Figure 1C:
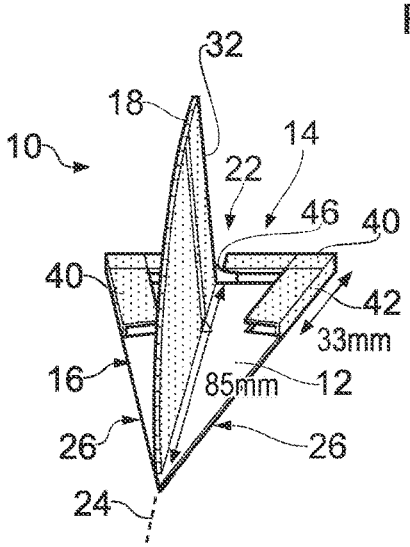
FIG. 1C shows an top end perspective view of the antenna shown in FIG. 1A.

With reference to FIGS. 1A, 1B and 1C there is shown an antenna 10 according to a first embodiment of the present invention, provided on a supporting substantially triangular planar PCB substrate 12. The antenna 10 comprises a balanced antenna 14 mounted on a first surface 16 of the triangular PCB 12 and an unbalanced antenna 18 in the form of a non-resonant element mounted on a second PCB substrate 20, which extends substantially perpendicularly from the first surface 16 of the triangular PCB 12. Both the balanced antenna 14 and the unbalanced antenna 18 are located towards the same end 22 of the triangular PCB 12.

The end 22 of the triangular PCB 12 constitutes a base of the triangular substrate, which further comprises a central axis of symmetry 24 and two sides 26 which are substantially equal in length. The second PCB 20 is located along the central axis 24 in the shape of a quarter-ellipse having a curved top surface 28 and a perpendicular end surface 30, which is located towards the base 22.

The unbalanced antenna 18 is constituted by a substantially rectangular planar etching 32 adjacent the perpendicular end 30 of the second PCB 20. A ground plane 34 is provided on the remainder of the second PCB 20, separated from the rectangular planar etching 32 by a gap 36. Although not shown, the unbalanced antenna 18 is provided with a feed line into feed point 38 which is located adjacent the triangular PCB 12, at the bottom of the rectangular planar etching 32 and at the point which is furthest from the end 22. In use, the unbalanced antenna 18 will operate as a Primary Antenna for transmit and receive functions.

The balanced antenna 14 comprises two inwardly facing symmetrical planar L-shaped arms 40 which generally conform to the outer shape of the triangular PCB 12, extending along the end 22 from its centre and partially along each side 26. Accordingly, each arm 40 has an internal angle of less than 90 degrees. As best illustrated in FIG. 1C, the L-shaped arms 40 are mounted above and parallel to the plane of the triangular PCB 12 and the area of the triangular PCB 12 which is directly underneath the arms 40 is cut-away for improved performance. Thus, although not shown, each arm 40 is in practice mounted on a support which is connected to the triangular PCB 12.

Each arm 40 further comprises orthogonal elements 42 depending from an outer edge of each L-shaped arm 40 to form L-shaped brackets. Notably, the orthogonal elements 42 and the arms 40 do not meet in the centre of the end 22 but define a gap 44 therebetween. Two feed lines 46 (extending from a second surface 48 of the triangular PCB 12) are provided towards the centre of the balanced antenna 14, one on each side of the gap 44, to respectively feed each arm 40. The second surface 48 is also provided a rectangular ground plane 49 for the balanced antenna 14, which is located centrally along the end 22. In use, the balanced antenna 14 will operate as a Secondary Antenna for MIMO functions.

As illustrated, the antenna 10 is 100 mm long, 50 mm wide and 45 mm high and its configuration will easily be accommodated into a shark-fin antenna housing for mounting on the roof of a vehicle.

Figure 2:
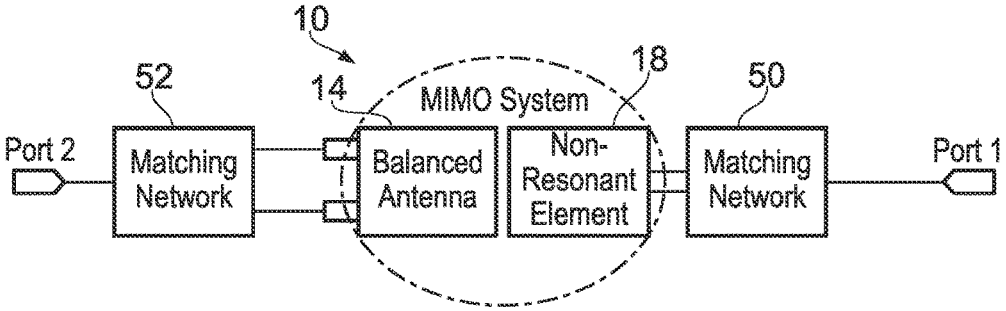
FIG. 2 shows a block diagram of the circuitry associated with the antenna of FIGS. 1A through 1C.

FIG. 2 shows a block diagram of the circuitry associated with the antenna 10. Accordingly, it can be seen that the non-resonant element of the unbalanced antenna 18 is fed through Port 1 via a matching circuit 50 and the balanced antenna 14 is fed through Port 2 via a matching circuit 52. As will be explained below, the external matching circuits 50, 52 are required to achieve a wide operating frequency range.

Figure 3:
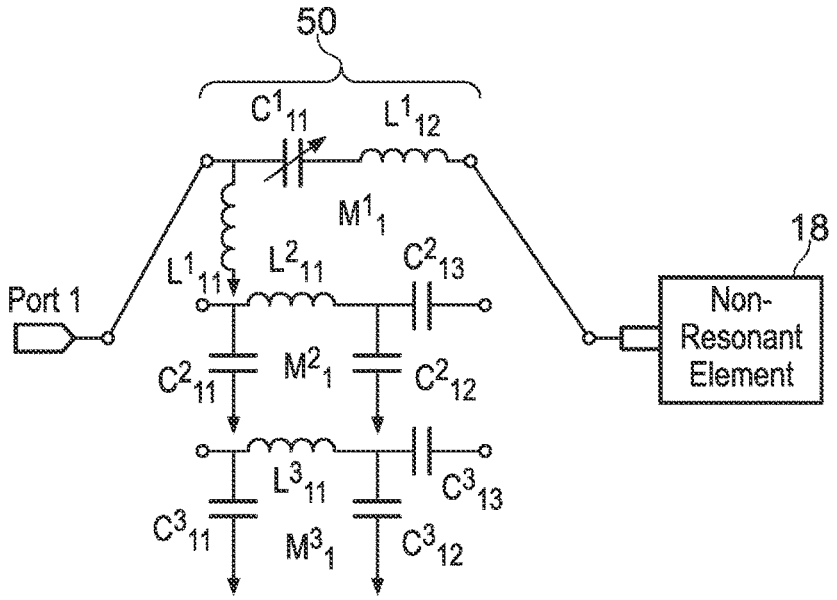
FIG. 3 shows a circuit diagram illustrating the matching circuit arrangement for the non-resonant element in the antenna of FIG. 2.

FIG. 3 shows a circuit diagram illustrating the matching circuit 50 for the non-resonant element 18. In this embodiment, the matching circuit 50 comprises three alternative matching circuits denoted $M_1^1$, $M_1^2$ and $M_1^3$, which can be individually selected to provide three different modes of operation (Mode 1, Mode 2 and Mode 3, respectively). Consequently, each matching circuit $M_1^1$, $M_1^2$ and $M_1^3$ can be selected by switches via a control system (not shown) such that Port 1 is connected to the non-resonant element 18 via the desired matching circuit to give the mode of operation required. In the embodiment shown, matching circuit $M_1^1$ is selected and the non-resonant element 18 is configured for operation in Mode 1.

Matching circuit $M_1^1$ comprises a first inductor $L_{11}^1$ connected in parallel to a variable capacitor $C_{11}^1$ which, in turn, is connected to a second inductor $L_{12}^1$. Matching circuit $M_1^2$ comprises a first capacitor $C_{11}^2$ connected in parallel to a first inductor $L_{11}^2$, which is then connected in parallel to a second capacitor $C_{12}^2$ and in series to a third capacitor $C_{13}^2$. Matching circuit $M_1^3$ comprises a first capacitor $C_{11}^3$ connected in parallel to a first inductor $L_{11}^3$, which is then connected in parallel to a second capacitor $C_{12}^3$ and in series to a third capacitor $C_{13}^3$.

Figure 4:
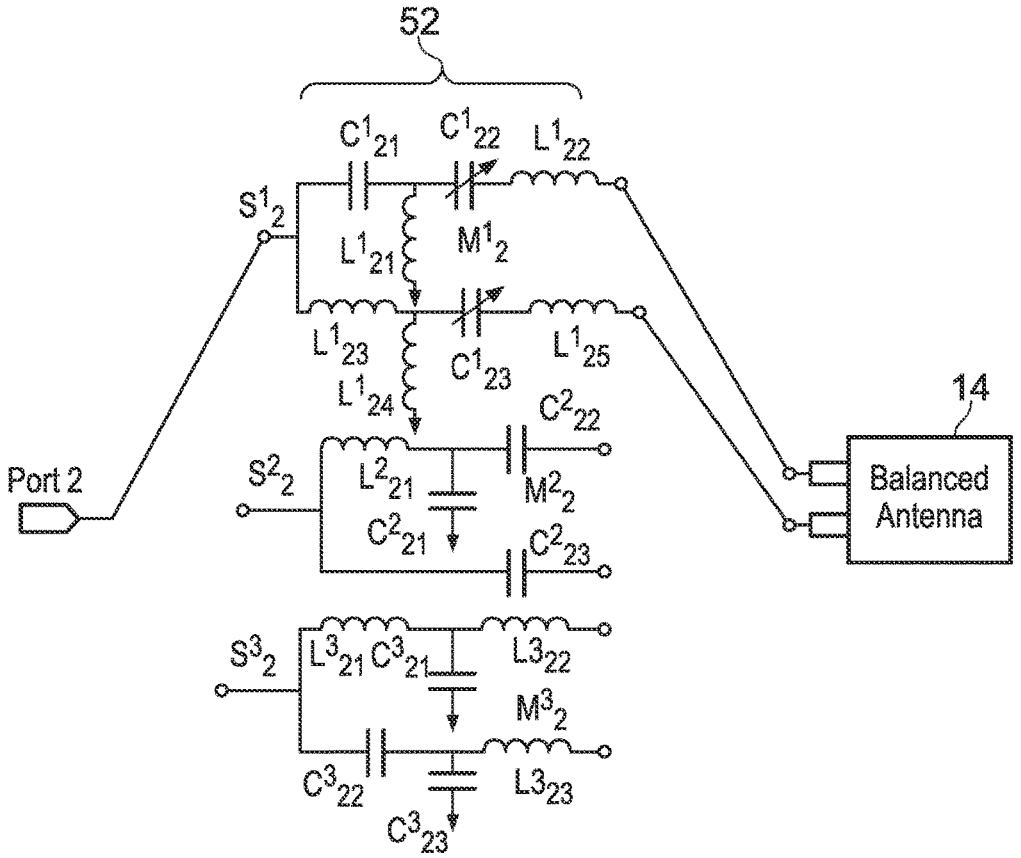
FIG. 4 shows a circuit diagram illustrating the matching circuit arrangement for the balanced antenna in the antenna of FIG. 2.

FIG. 4 shows a circuit diagram illustrating the matching circuit arrangement 52 for the balanced antenna 14. In this embodiment, the matching circuit 52 comprises three alternative matching circuits denoted $M_2^1$, $M_2^2$ and $M_2^3$, which can also be individually selected to provide three different modes of operation (Mode 1, Mode 2 and Mode 3, respectively). Consequently, each matching circuit $M_2^1$, $M_2^2$ and $M_2^3$ can be selected by switches via a control system (not shown) such that Port 2 is connected to the balanced antenna 14 via the desired matching circuit to give the mode of operation required. In the embodiment shown, matching circuit $M_2^1$ is selected and the balanced antenna 14 is configured for operation in Mode 1.

Matching circuit $M_2^1$ comprises a splitter $S_2^1$ which splits the signal from Port 2 into a first branch and a second branch. The first branch comprises a first capacitor $C_{21}^1$ connected in parallel to a first inductor $L_{11}^1$ and in series to a second (variable) capacitor $C_{22}^1$ and a second inductor $L_{22}^1$. The second branch comprises a third inductor $L_{23}^1$ connected in parallel to a fourth inductor $L_{24}^1$ and in series to a third (variable) capacitor $C_{23}^1$ and a fifth inductor $L_{25}^1$.

Matching circuit $M_2^2$ comprises a splitter $S_2^2$ which splits the signal from Port 2 into a first branch and a second branch. The first branch comprises a first inductor $L_{21}^2$ connected in parallel to a first capacitor $C_{21}^2$ and in series to a second capacitor $C_{22}^2$. The second branch comprises a third series capacitor $C_{23}^2$.

Matching circuit $M_2^3$ comprises a splitter $S_2^3$ which splits the signal from Port 2 into a first branch and a second branch. The first branch comprises a first series inductor $L_{21}^3$ connected in parallel to a first conductor $C_{21}^3$ and in series to a second inductor $L_{22}^3$. The second branch comprises a second capacitor $C_{22}^3$ connected in parallel to a third conductor $C_{23}^3$ and in series to a third inductor $L_{23}^3$.

In summary, there is one variable capacitor in matching circuit $M_1^1$ and two variable capacitors in matching circuit $M_2^1$. These variable capacitors may comprise several fixed capacitors with switches, varactors, MEMS capacitors or the like.

The matching circuits of FIGS. 3 and 4 are designed to cover three LTE frequency bands (i.e. 698 MHz to 960 MHz, 1710 MHz to 2170 MHz and 2300 MHz to 2690 MHz) as well as other common required frequency ranges. More specifically, when operating in Mode 1 (i.e. matching circuits $M_1^1$ and $M_2^1$ are selected), Port 1 and Port 2 can cover the LTE low band which is from 698 MHz to 960 MHz. When operating in Mode 2 (i.e. matching circuits $M_1^2$ and $M_2^2$ are selected), Port 1 and Port 2 can cover the LTE mid band which is from 1710 MHz to 2170 MHz plus UMTS2100. When operating in Mode 3 (i.e. matching circuits $M_1^3$ and $M_2^3$ are selected), Port 1 can cover LTE high band 2300 MHz to 2690 MHz, WiFi and Bluetooth while Port 2 can cover most of LTE high band 2500 MHz to 2690 MHz. It will be understood that other frequency bands can be covered by including additional matching circuits which are selected by switches to provide further modes of operation.

Figure 5:
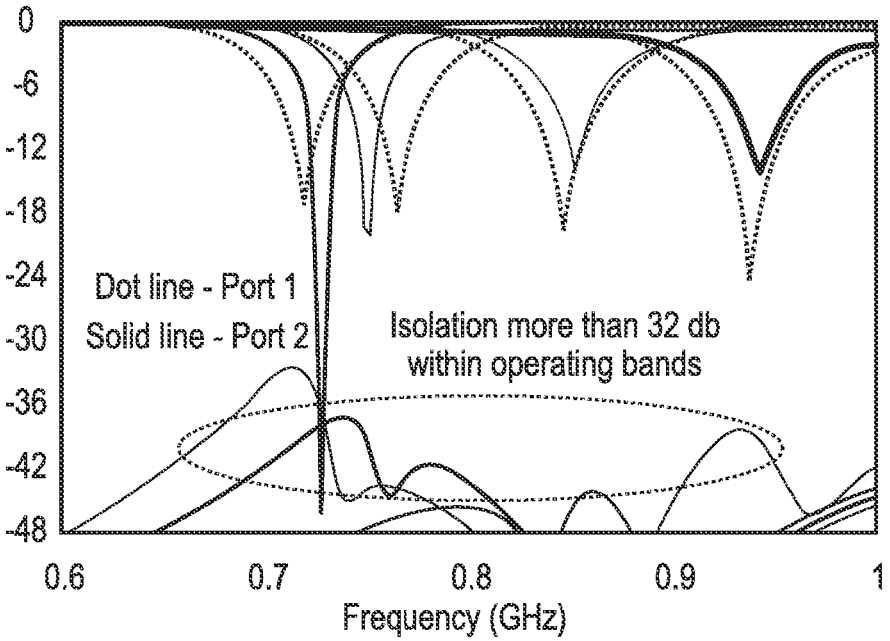
FIG. 5 shows a graph of return loss against frequency for the antenna of FIGS. 1A to 4, when operating in mode 1 (i.e. when matching circuits $M_1^1$ and $M_2^1$ are selected and the variable capacitors are varied)

FIG. 5 shows a graph of return loss against frequency for the antenna of FIGS. 1A to 4, when operating in Mode 1 (i.e. when matching circuits $M_1^1$ and $M_2^1$ are selected) and the variable capacitors are varied. Accordingly, by varying the capacitor value, it is possible to tune the resonant frequencies of Port 1 and Port 2 to cover the LTE low band between approximately 698 MHz and 960 MHz with an isolation of at least 32 dB over the operating band.

Figure 6:
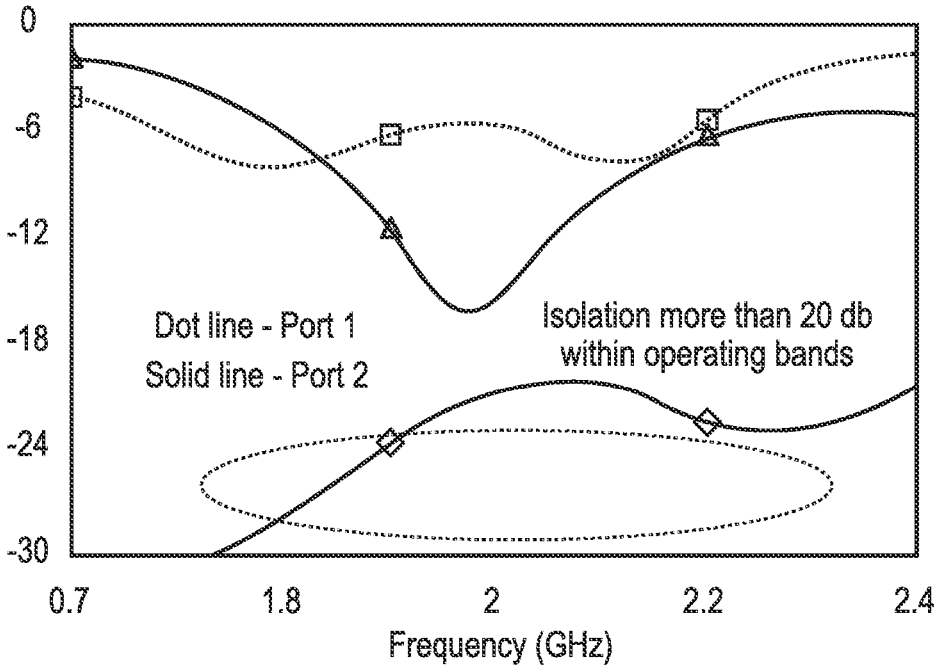
FIG. 6 shows a graph of return loss against frequency for the antenna of FIGS. 1A to 4, when operating in mode 2 (i.e. when matching circuits $M_1^2$ and $M_2^2$ are selected)

FIG. 6 shows a graph of return loss against frequency for the antenna of FIGS. 1A to 4, when operating in mode 2 (i.e. when matching circuits $M_1^2$ and $M_2^2$ are selected). Accordingly, it is possible to cover the frequencies between approximately 1710 MHz and 2170 MHz with Port 1 while Port 2 operates from 1805 MHz to 2170 MHz, with an isolation of at least 20 dB over these operating bands.

Figure 7:
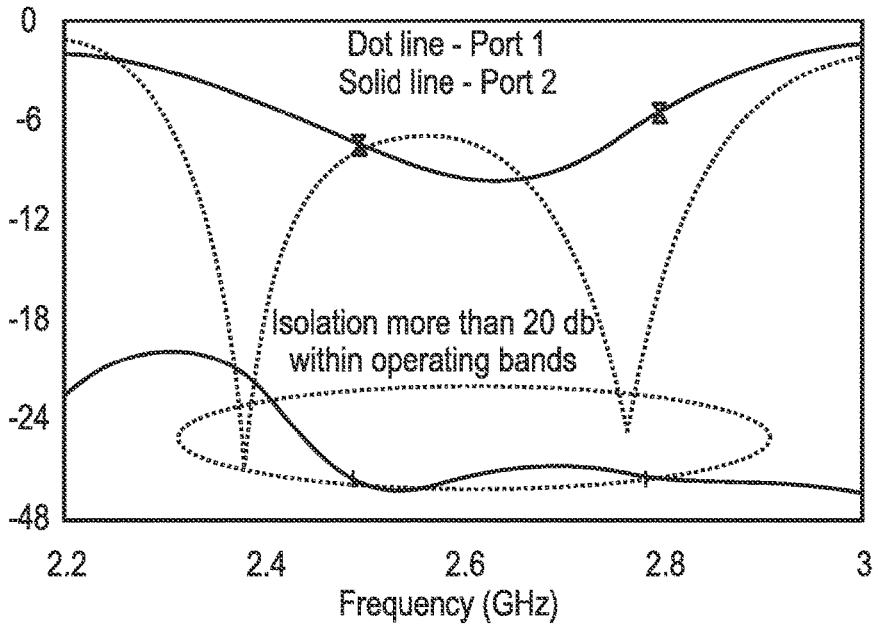
FIG. 7 shows a graph of return loss against frequency for the antenna of FIGS. 1A to 4, when operating in mode 3 (i.e. when matching circuits $M_1^3$ and $M_2^3$ are selected)

FIG. 7 shows a graph of return loss against frequency for the antenna of FIGS. 1A to 4, when operating in mode 3 (i.e. when matching circuits $M_1^3$ and $M_2^3$ are selected). Accordingly, it is possible to cover the frequencies between approximately 2300 MHz and 2690 MHz with an isolation of at least 20 dB over the operating band.

It should be noted that there is no tuning circuit for modes 2 and 3, thus no need to use variable capacitors, as the matching circuits with fixed components can cover the required frequency bands.

Figure 8B:
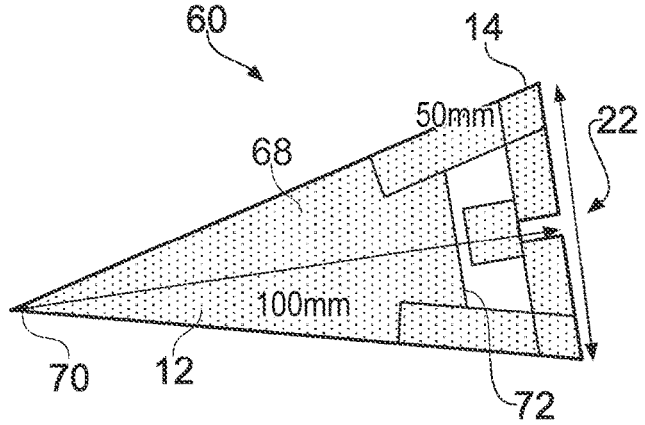
FIG. 8B shows an underside view of the antenna shown in FIG. 8A.
Figure 8A:
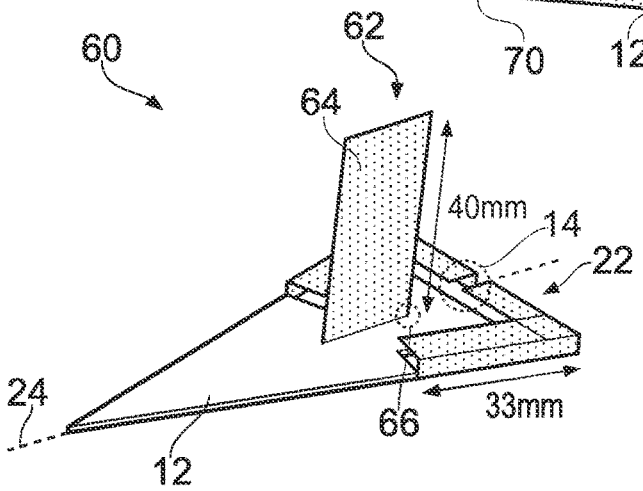
FIG. 8A shows a top side perspective view of an antenna according to a second embodiment of the present invention.

FIGS. 8A and 8B show an antenna 60 according to a second embodiment of the present invention. The antenna 60 is substantially similar to that shown in FIGS. 1A through 1C except for the structure of the unbalanced antenna 62. More specifically, the unbalanced antenna 62, operating as the Primary Antenna, comprises a non-resonant rectangular copper plate 64 (40 mm high and 20 mm wide) which is mounted perpendicularly to the triangular PCB 12, but without the second PCB of the first embodiment. The plate 64 is located on the central axis 24 towards the end 22 of the triangular PCB 12. Although not shown, the unbalanced antenna 62 is provided with a feed line into feed point 66 which is located adjacent the triangular PCB 12, at the bottom of the plate 64 and at the point which is closest to the end 22. A ground plane 68 is provided on the opposite second surface 48 of the triangular PCB 12 and extends from a tip 70 (opposite the end 22) of the triangular PCB 12 as far as a transverse line 72 which is in line with the end of the plate 64 which is closest to the end 22. The feed line of the unbalanced antenna 62 connects the feed point 66 to the ground plane 68 centrally of the balanced antenna 14. An advantage of this particular structure over that in FIGS. 1A to 1C, is that more space is made available on the triangular PCB 12 for other possible antennas (for example, which may have circular polarisation) and/or any other devices or components (for example, for the associated matching circuits for the antennas).

The circuit arrangement shown in FIG. 2 is also employed in relation to the antenna 60.

Figure 9:
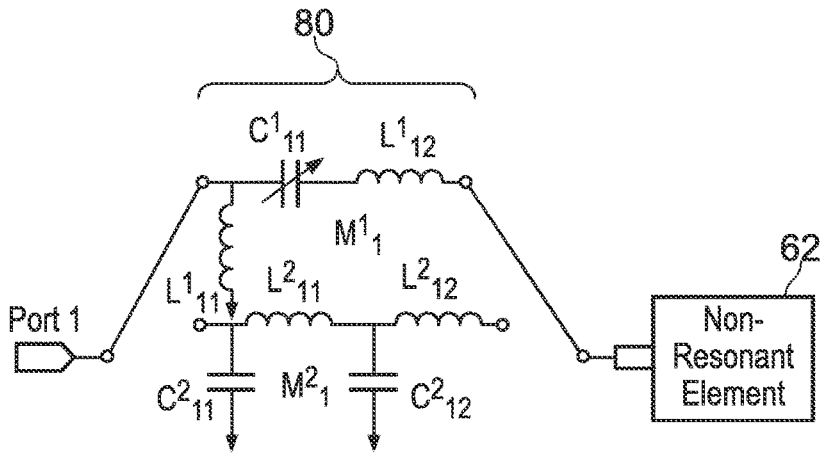
FIG. 9 shows a circuit diagram illustrating the matching circuit arrangement for the non-resonant element in the antenna of FIGS. 8A and 8B.

FIG. 9 shows a circuit diagram illustrating a matching circuit 80 for the non-resonant element 62 of FIGS. 8A and 8B. In this embodiment, the matching circuit 80 comprises only two alternative matching circuits denoted $M_1^1$ and $M_1^2$, which can be individually selected to provide two different modes of operation (Mode 1 and Mode 2, respectively). Consequently, each matching circuit $M_1^1$ and $M_1^2$ can be selected by switches via a control system (not shown) such that Port 1 is connected to the non-resonant element 62 via the desired matching circuit to give the mode of operation required. In the embodiment shown, matching circuit $M_1^1$ is selected and the non-resonant element 62 is configured for operation in Mode 1.

Matching circuit $M_1^1$ comprises a first inductor $L_{11}^1$ connected in parallel to a variable capactor $C_{11}^1$ which, in turn, is connected to a second inductor $L_{12}^1$. Matching circuit $M_1^2$ comprises a first capactor $C_{11}^2$ connected in parallel to a first inductor $L_{11}^2$, which is then connected in parallel to a second capacitor $C_{12}^2$ and in series to a second inductor $L_{12}^2$.

FIG. 1C shows a circuit diagram illustrating a matching circuit arrangement 82 for the balanced antenna 14 of FIGS. 8A and 8B. In this embodiment, the matching circuit 82 comprises three alternative matching circuits denoted $M_2^1$, $M_2^2$ and $M_2^3$, which can also be individually selected to provide three different modes of operation (Mode 1, Mode 2 and Mode 3, respectively). Consequently, each matching circuit $M_2^1$, $M_2^2$ and $M_2^3$ can be selected by switches via a control system (not shown) such that Port 2 is connected to the balanced antenna 14 via the desired matching circuit to give the mode of operation required. In the embodiment shown, matching circuit $M_2^1$ is selected and the balanced antenna 14 is configured for operation in Mode 1.

Matching circuit $M_2^1$ comprises a splitter $S_2^1$ which splits the signal from Port 2 into a first branch and a second branch. The first branch comprises a first capacitor $C_{21}^1$ connected in parallel to a first inductor $L_{21}^1$ and in series to a second (variable) capacitor $C_{22}^1$ and a second inductor $L_{22}^1$. The second branch comprises a third series inductor $L_{23}^1$ connected in parallel to a fourth inductor $L_{24}^1$ and in series to a third (variable) capacitor $C_{23}^1$ and a fifth inductor $L_{25}^1$.

Matching circuit $M_2^2$ comprises a splitter $S_2^2$ which splits the signal from Port 2 into a first branch and a second branch. The first branch comprises a first capacitor $C_{21}^2$ connected in parallel to a second capacitor $C_{22}^2$ and in series to a third capacitor $C_{23}^2$. The second branch comprises a first series inductor $L_{21}^2$ connected in parallel to a fourth capacitor $C_{24}^2$ and in series to a fifth capacitor $C_{25}^2$.

Matching circuit $M_2^3$ comprises a splitter $S_2^3$ which splits the signal from Port 2 into a first branch and a second branch. The first branch comprises a first series inductor $L_{21}^3$ connected in parallel to a first conductor $C_{21}^3$ and in series to a second inductor $L_{22}^3$. The second branch comprises a second capacitor $C_{22}^3$ connected in parallel to a third inductor $L_{23}^3$ and in series to a fourth inductor $L_{24}^3$.

In summary, there is one variable capacitor in matching circuit $M_1^1$ and two variable capacitors in matching circuit $M_2^1$. These variable capacitors may comprise several fixed capacitors with switches, varactors, MEMS capacitors or the like.

Figure 10:
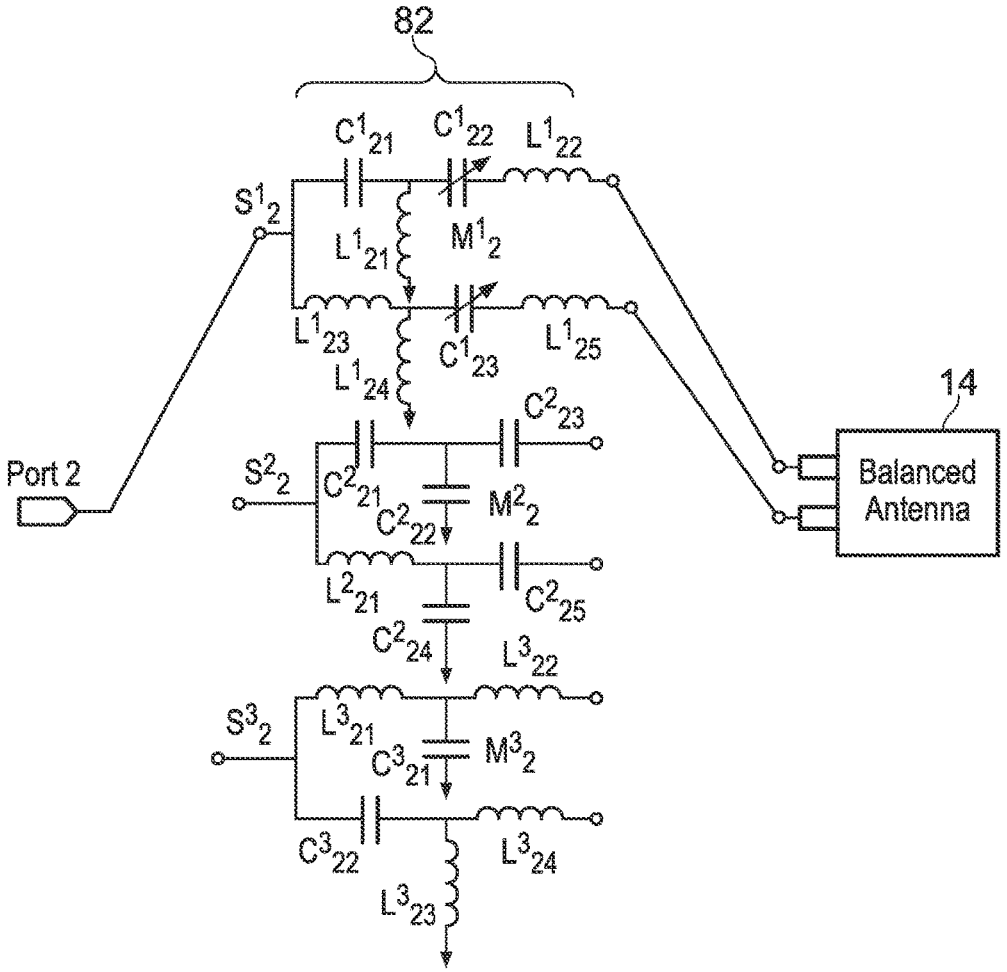
FIG. 10 shows a circuit diagram illustrating the matching circuit arrangement for the balanced antenna in the antenna of FIGS. 8A and 8B.

The matching circuits of FIGS. 9 and 10 are designed to cover a range of different frequency bands. More specifically, when both circuits are operating in Mode 1 (i.e. matching circuits $M_1^1$ and $M_2^1$ are selected), Port 1 and Port 2 can cover the LTE low band which is from 698 MHz to 960 MHz. When both circuits are operating in Mode 2 (i.e. matching circuits $M_1^2$ and $M_2^2$ are selected), Port 1 can operate from 1280 MHz to over 3000 MHz and Port 2 can operate from 1805 MHz to 2170 MHz. When the non-resonant element 62 is operating in Mode 2 and the balanced antenna is operating in Mode 3 (i.e. matching circuits $M_1^2$ and $M_2^3$ are selected), Port 1 can operate from 1280 MHz to over 3000 MHz while Port 2 can cover the LTE high band 2300 MHz to 2690 MHz. It will be understood that other frequency bands can be covered by including additional matching circuits which are selected by switches to provide further modes of operation.

Figure 11:
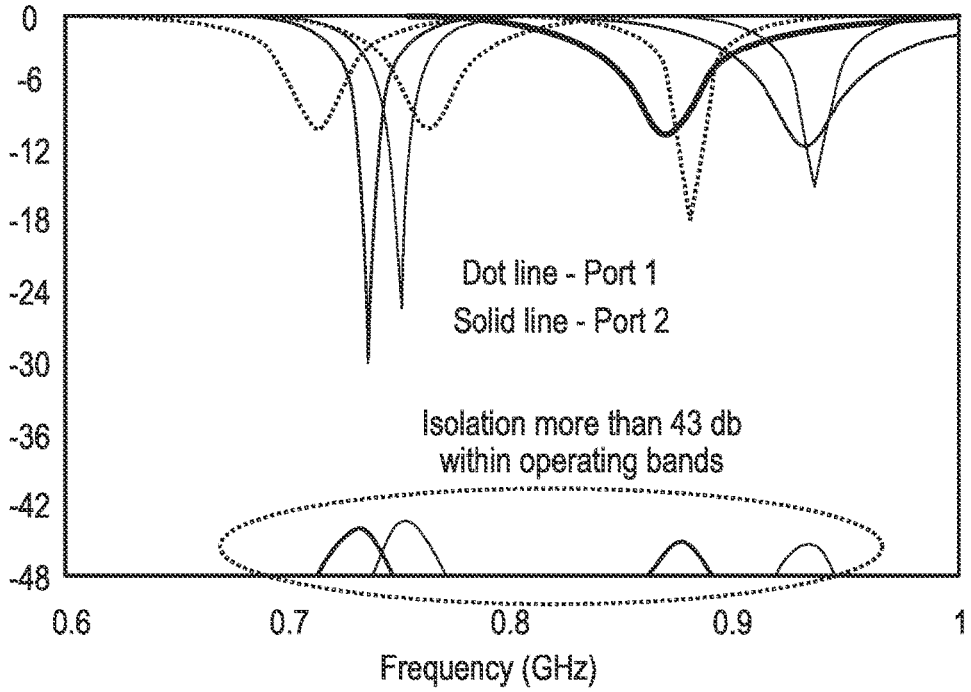
FIG. 11 shows a graph of return loss against frequency for the antenna of FIGS. 8A and 8B, when operating in mode 1 (i.e. when matching circuits $M_1^1$ and $M_2^1$ are selected and the variable capacitors are varied)

FIG. 11 shows a graph of return loss against frequency for the antenna of FIGS. 8A and 8B when both antennas are operating in Mode 1 (i.e. when matching circuits $M_1^1$ and $M_2^1$ are selected) and the variable capacitors are varied. Accordingly, by varying the capacitor value, it is possible to tune the resonant frequencies of Port 1 and Port 2 to cover the LTE low band between approximately 698 MHz and 960 MHz with an isolation of at least 43 dB over the operating band.

Figure 12:
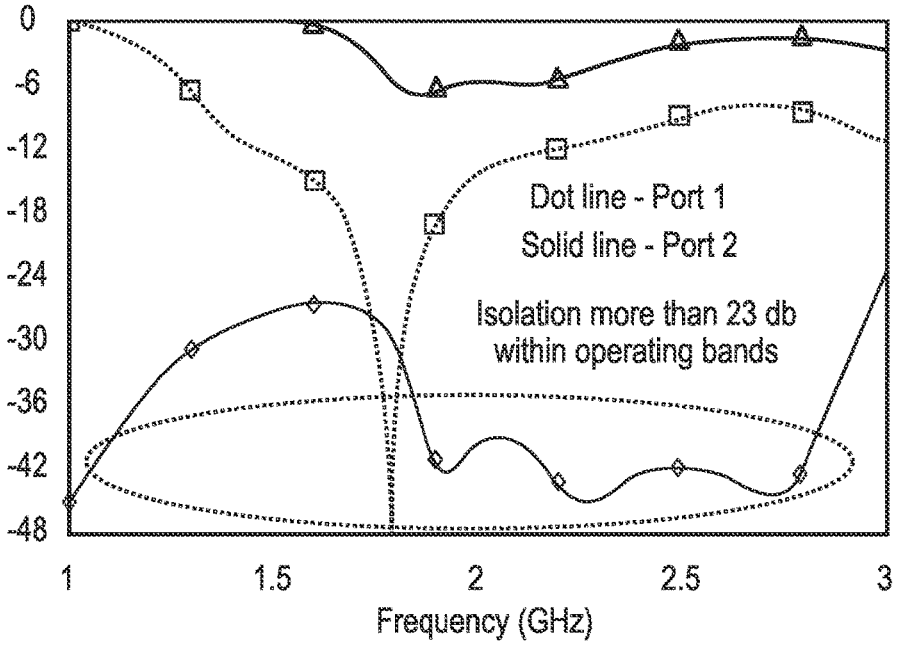
FIG. 12 shows a graph of return loss against frequency for the antenna of FIGS. 8A and 8B, when operating in mode 2 (i.e. when matching circuits $M_1^2$ and $M_2^2$ are selected)

FIG. 12 shows a graph of return loss against frequency for the antenna of FIGS. 8A and 8B, when both antennas are operating in mode 2 (i.e. when matching circuits $M_1^2$ and $M_2^2$ are selected). Accordingly, it is possible for Port 1 to cover the frequencies from approximately 1280 MHz to over 3000 MHz while Port 2 operates from 1805 MHz to 2170 MHz, with an isolation of at least 23 dB over these operating bands.

Figure 13:
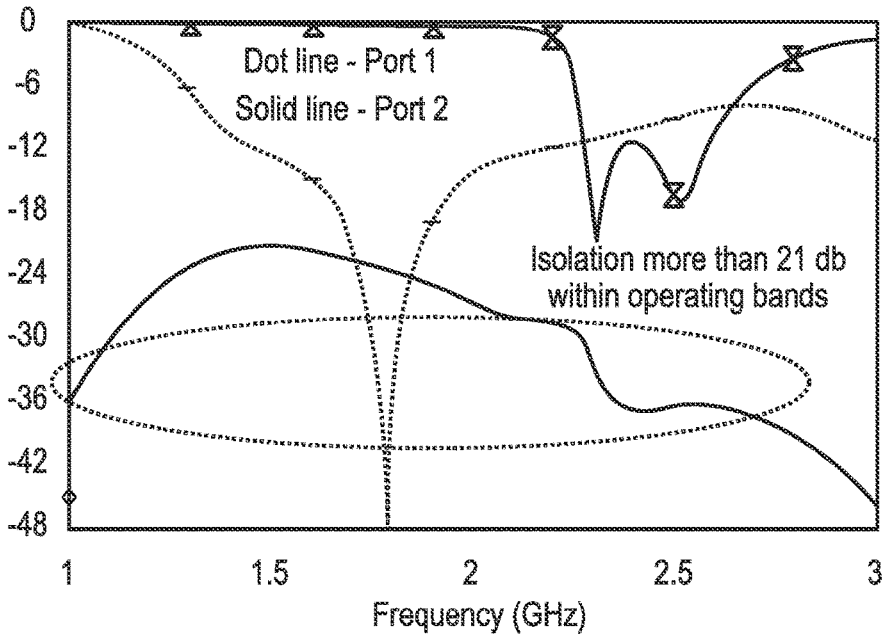
FIG. 13 shows a graph of return loss against frequency for the antenna of FIGS. 8A and 8B, when operating in mode 3 (i.e. when matching circuits $M_1^2$ and $M_1^3$ are selected)

FIG. 13 shows a graph of return loss against frequency for the antenna of FIGS. 8A and 8B, when the non-resonant element 62 is operating in Mode 2 and the balanced antenna is operating in Mode 3 (i.e. when matching circuits $M_1^2$ and $M_2^3$ are selected). Accordingly, it is possible for Port 1 to cover the frequencies from approximately 1280 MHz to over 3000 MHz while Port 2 operates from 2300 MHz to 2690 MHz, with an isolation of at least 21 dB over these operating bands.

It should be noted that there is no tuning circuit for modes 2 and 3, thus no need to use variable capacitors, as the matching circuits with fixed components can cover the required frequency bands.

Figure 14B:
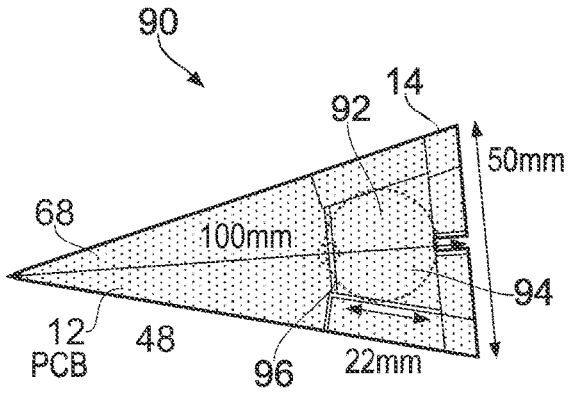
FIG. 14B shows an underside view of the antenna shown in FIG. 14A.
Figure 14A:
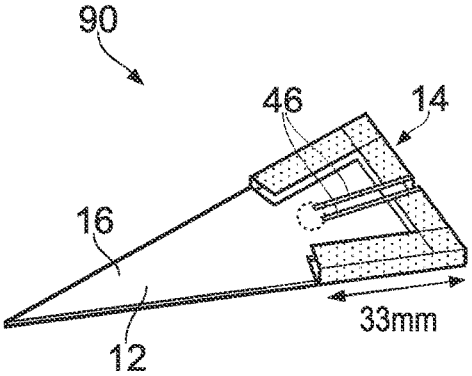
FIG. 14A shows a top side perspective view of an antenna according to a third embodiment of the present invention.

FIGS. 14A and 14B show an antenna 90 according to a third embodiment of the present invention. The antenna 90 is substantially similar to that shown in FIGS. 8A and 8B except for the structure of the unbalanced antenna 92. More specifically, the non-resonant element 94, operating as the Primary Antenna, is etched onto the second surface 48 of the triangular PCB 12 in the area enclosed by the balanced antenna 14. Accordingly, the ground plane 68 only extends as far as the balanced antenna 14 and a gap 96 is provided between the ground plane 68 and the non-resonant element 94. In this embodiment, the feed lines 46 for the balanced antenna 14 extend centrally along the first surface 16 of the triangular PCB 12 before connecting to the ground plane 68 beneath. Accordingly, the feed points of each of the balanced antenna 14 and the unbalanced antenna 90 are close. However, high isolation can be achieved by ensuring that the balanced antenna 14 and the unbalanced antenna 90 have a maximum 90 degree phase difference in polarisation orientation.

The dimensions for the antenna 90 are: 100 mm long, 50 mm wide and only 4 mm high. Thus, an advantage of this particular structure over that in FIGS. 1A to 1C and 8A and 8B, is that both antennas lie 'flat' (i.e. they are both parallel to the plane of the triangular PCB 12) and therefore this configuration can easily be accommodated into a small automobile roof-mounted device requiring much less height.

The circuit arrangement shown in FIG. 2 is also employed in relation to the antenna 90.

Figure 15:
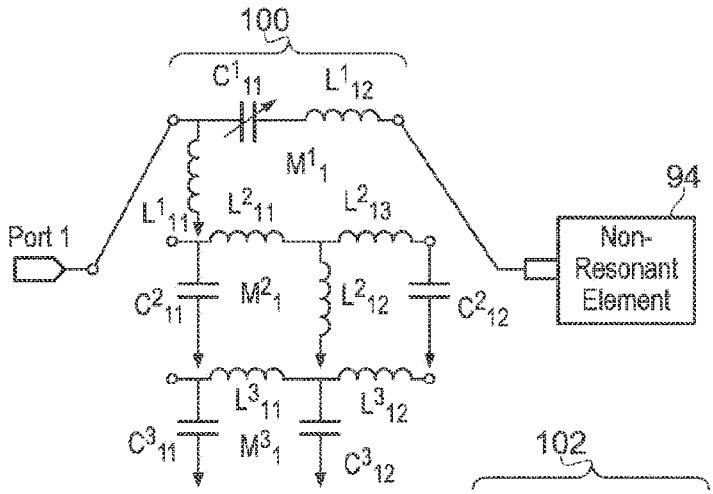
FIG. 15 shows a circuit diagram illustrating the matching circuit arrangement for the non-resonant element in the antenna of FIGS. 14A and 14B.

FIG. 15 shows a circuit diagram illustrating a matching circuit 100 for the non-resonant element 94 of FIGS. 14A and 14B. In this embodiment, the matching circuit 100 comprises three alternative matching circuits denoted $M_1^1$, $M_1^2$ and $M_1^3$, which can be individually selected to provide three different modes of operation (Mode 1, Mode 2 and Mode 3, respectively). Consequently, each matching circuit $M_1^1$, $M_1^2$ and $M_1^3$ can be selected by switches via a control system (not shown) such that Port 1 is connected to the non-resonant element 94 via the desired matching circuit to give the mode of operation required. In the embodiment shown, matching circuit $M_1^1$ is selected and the non-resonant element 94 is configured for operation in Mode 1.

Matching circuit $M_1^1$ comprises a first inductor $L_{11}^1$ connected in parallel to a variable capacitor $C_{11}^1$ which, in turn, is connected in series to a second inductor $L_{12}^1$. Matching circuit $M_1^2$ comprises a first capacitor $C_{11}^2$ connected in parallel to a first inductor $L_{11}^2$, which is then connected in parallel to a second inductor $L_{12}^2$ and in series to a third inductor $L_{13}^2$, which is itself connected in parallel to a second capacitor $C_{12}^2$. Matching circuit $M_1^3$ comprises a first capacitor $C_{11}^3$ connected in parallel to a first inductor $L_{11}^3$, which is then connected in parallel to a second capacitor $C_{12}^3$ and in series to a second inductor $L_{12}^3$.

Figure 16:
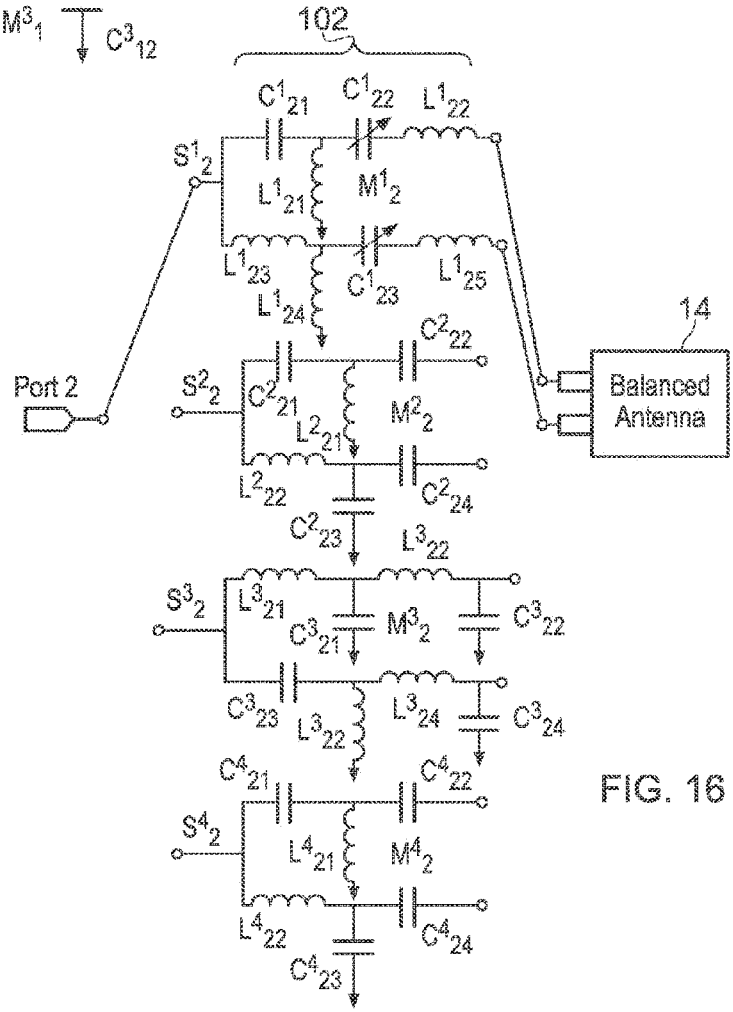
FIG. 16 shows a circuit diagram illustrating the matching circuit arrangement for the balanced antenna in the antenna of FIGS. 14A and 14B.

FIG. 16 shows a circuit diagram illustrating a matching circuit arrangement 102 for the balanced antenna 14 of FIGS. 14A and 14B. In this embodiment, the matching circuit 102 comprises four alternative matching circuits denoted $M_2^1$, $M_2^2$, $M_2^3$ and $M_2^4$, which can also be individually selected to provide four different modes of operation (Mode 1, Mode 2, Mode 3 and Mode 4, respectively). Consequently, each matching circuit $M_2^1$, $M_2^2$, $M_2^3$ and $M_2^4$ can be selected by switches via a control system (not shown) such that Port 2 is connected to the balanced antenna 14 via the desired matching circuit to give the mode of operation required. In the embodiment shown, matching circuit $M_2^1$ is selected and the balanced antenna 14 is configured for operation in Mode 1.

Matching circuit $M_2^1$ comprises a splitter 51 which splits the signal from Port 2 into a first branch and a second branch. The first branch comprises a first capacitor $C_{21}^1$ connected in parallel to a first inductor $L_{21}^1$ and in series to a second (variable) capacitor $C_{22}^1$ and a second inductor $L_{22}^1$. The second branch comprises a third inductor $L_{23}^1$ connected in parallel to a fourth inductor $L_{24}^1$ and in series to a third (variable) capacitor $C_{23}^1$ and a fifth inductor $L_{25}^1$.

Matching circuit $M_2^2$ comprises a splitter $S_2^2$ which splits the signal from Port 2 into a first branch and a second branch. The first branch comprises a first capacitor $C_{21}^2$ connected in parallel to a first inductor $L^2_{21}$ and in series to a second capacitor $C_{22}^2$. The second branch comprises a second series inductor $L_{22}^2$ connected in parallel to a third capacitor $C_{23}^2$ and in series to a fourth capacitor $C_{24}^2$.

Matching circuit $M_2^3$ comprises a splitter $S_2^3$ which splits the signal from Port 2 into a first branch and a second branch. The first branch comprises a first series inductor $L_{21}^3$ connected in parallel to a first conductor $C_{21}^3$ and in series to a second inductor $L_{22}^3$, which is then connected in parallel to a second conductor $C_{22}^3$. The second branch comprises a third capacitor $C_{23}^3$ connected in parallel to a third inductor $L_{23}^3$ and in series to a fourth inductor $L_{24}^3$ which is then connected in parallel to a fourth capacitor $C_{24}^3$.

Matching circuit $M_2^4$ comprises a splitter $S_2^4$ which splits the signal from Port 2 into a first branch and a second branch. The first branch comprises a first series conductor $C_{21}^4$ connected in parallel to a first inductor $L_{21}^4$ and in series to a second capacitor $C_{22}^4$. The second branch comprises a second inductor $L_{22}^4$ connected in parallel to a third capacitor $C_{23}^4$ and in series to a fourth capacitor $C_{24}^4$.

In summary, there is one variable capacitor in matching circuit $M_1^1$ and two variable capacitors in matching circuit $M_2^1$. These variable capacitors may comprise several fixed capacitors with switches, varactors, MEMS capacitors or the like.

The matching circuits of FIGS. 15 and 16 are designed to cover a range of different frequency bands. More specifically, when both antennas are operating in Mode 1 (i.e. matching circuits $M_1^1$ and $M_2^1$ are selected), Port 1 and Port 2 can cover the LTE low band which is from 698 MHz to 960 MHz. When both antennas are operating in Mode 2 (i.e. matching circuits $M_1^2$ and $M_2^2$ are selected), Port 1 can operate from 1249 MHz to 2170 MHz and Port 2 can operate from 1790 MHz to 1935 MHz. When the non-resonant element 94 is operating in Mode 2 and the balanced antenna 14 is operating in Mode 3 (i.e. matching circuits $M_1^2$ and $M_2^3$ are selected), Port 1 can operate from 1249 MHz to 2170 MHz while Port 2 can cover from 1970 MHz to 2170 MHz. When the non-resonant element 94 is operating in Mode 3 and the balanced antenna 14 is operating in Mode 4 (i.e. matching circuits $M_1^3$ and $M_2^4$ are selected), Port 1 can operate from 2300 MHz to 2690 MHz while Port 2 can cover from 2500 MHz to 2690 MHz. It will be understood that other frequency bands can be covered by including additional matching circuits which are selected by switches to provide further modes of operation.

Figure 17:
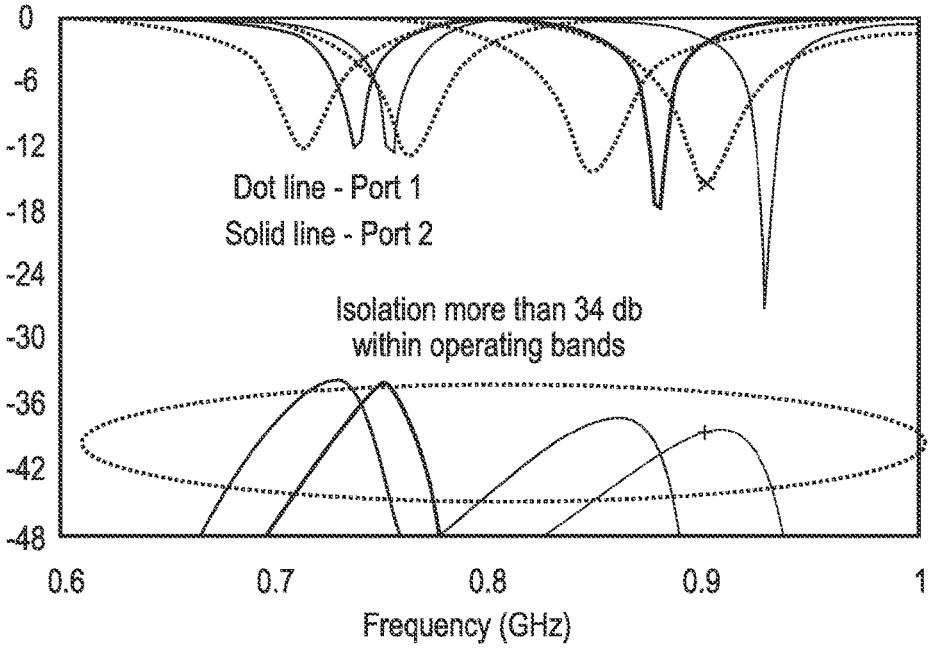
FIG. 17 shows a graph of return loss against frequency for the antenna of FIGS. 14A and 14B, when operating in mode 1 (i.e. when matching circuits $M_1^1$ and $M_2^1$ are selected and the variable capacitors are varied)

FIG. 17 shows a graph of return loss against frequency for the antenna of FIGS. 14A and 14B when both antennas are operating in Mode 1 (i.e. when matching circuits $M_1^1$ and $M_2^1$ are selected) and the variable capacitors are varied. Accordingly, by varying the capacitor value, it is possible to tune the resonant frequencies of Port 1 and Port 2 to cover the LTE low band between approximately 698 MHz and 960 MHz with an isolation of at least 34 dB over the operating band.

Figure 18:
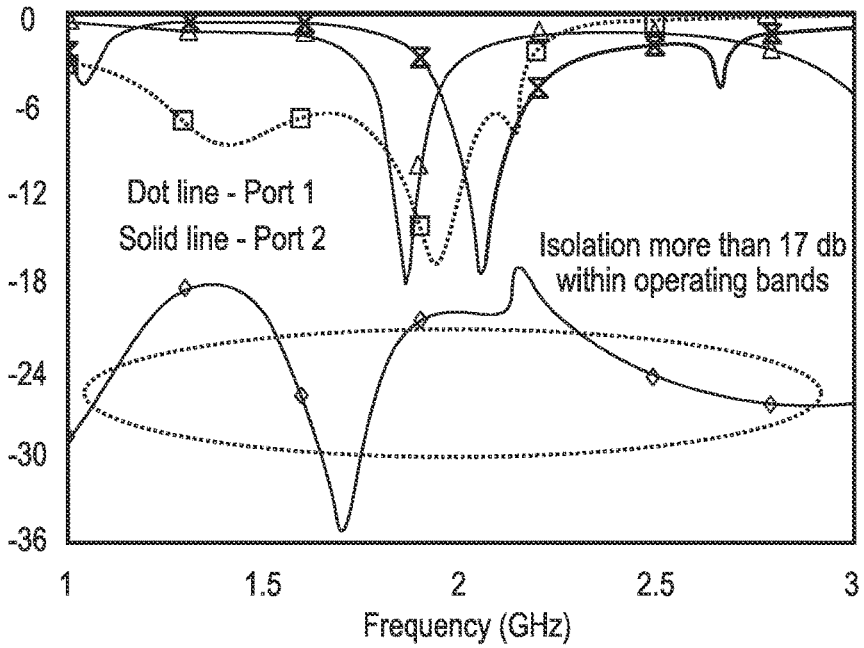
FIG. 18 shows a graph of return loss against frequency for the antenna of FIGS. 14A and 14B, when operating in mode 2 (i.e. when matching circuits $M_1^2$ and $M_2^2$ are selected) and when operating in mode 3 (i.e. when matching circuits $M_1^2$ and $M_2^3$ are selected)

FIG. 18 shows a graph of return loss against frequency for the antenna of FIGS. 14A and 14B, when the non-resonant element 62 is operating in Mode 2 and when the balanced antenna is operating in either Mode 2 or Mode 3 (i.e. when matching circuit $M_1^2$ and either of $M_2^2$ or $M_2^3$ is selected). Accordingly, it is possible for Port 1 to cover the frequencies from approximately 1249 MHz to 2170 MHz while Port 2 either operates from 1790 MHz to 1935 MHz (in Mode 2) or 1970 MHz to 2170 MHz (in Mode 3), with an isolation of at least 17 dB over these operating bands.

Figure 19:
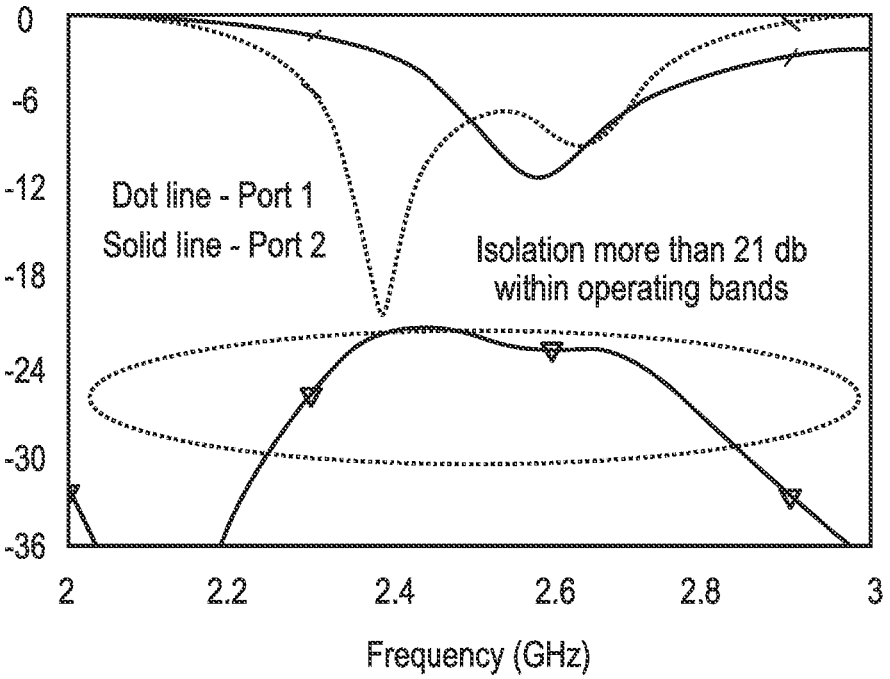
FIG. 19 shows a graph of return loss against frequency for the antenna of FIGS. 14A and 14B, when operating in mode 4 (i.e. when matching circuits $M_1^3$ and $M_2^4$ are selected)

FIG. 19 shows a graph of return loss against frequency for the antenna of FIGS. 14A and 14B, when the non-resonant element 62 is operating in Mode 3 and the balanced antenna is operating in Mode 4 (i.e. when matching circuits $M_1^3$ and $M_2^4$ are selected). Accordingly, it is possible for Port 1 to cover the frequencies from approximately 2300 MHz to 2690 MHz while Port 2 operates from 2500 MHz to 2690 MHz, with an isolation of at least 21 dB over these operating bands.

It should be noted that there is no tuning circuit for modes 2, 3 or 4, thus no need to use variable capacitors, as the matching circuits with fixed components can cover the required frequency bands.

Figure 20:
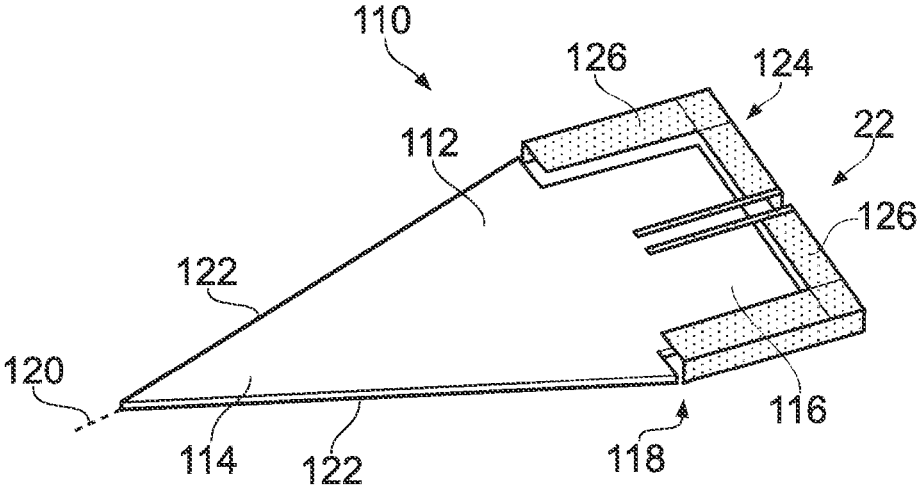
FIG. 20 shows a top side perspective view of an antenna according to a fourth embodiment of the present invention, wherein the substrate is triangular-rectangular shaped.

FIG. 20 shows a top perspective view of an antenna 110 according to a fourth embodiment of the present invention. The antenna 110 is substantially similar to that shown in FIGS. 14A and 14B except that the supporting PCB 112 comprises a triangular planar element 114 and a rectangular planar element 116. The triangular planar element 114 comprises a base 118, a central axis of symmetry 120 and two sides 122 which are substantially equal in length. The rectangular planar element 116 extends from the base 118 to the end 22 of the antenna 110. A balanced antenna 124, similar to the balanced antenna 14, is provided at the end 22 and conforms to the outer shape of the rectangular planar element 116, with the area under the L-shaped arms 126 of the balanced antenna 124 cut-away for improved performance. Thus, in this embodiment, the L-shaped arms 126 each have an internal angle of 90 degrees. Furthermore, the balanced antenna 124 is mounted to the rectangular planar element 116 by foam supports or the like (not shown).

Figure 21:
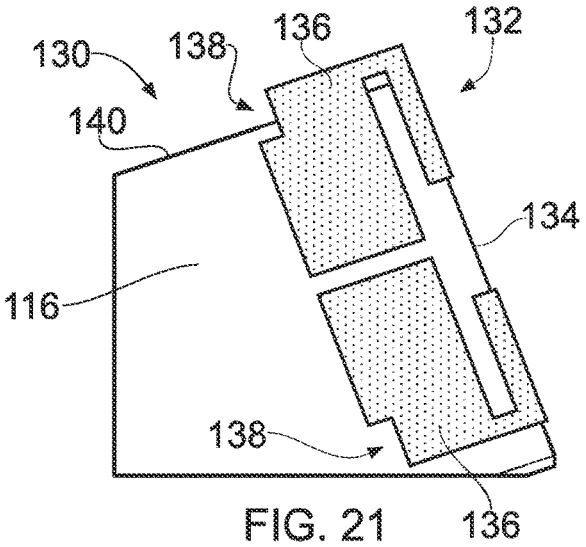
FIG. 21 shows a partial top side perspective view of an antenna similar to that shown in FIG. 20 but wherein the balanced antenna comprises a printed dipole.

FIG. 21 shows a partial top side perspective view of an antenna 130 similar to that shown in FIG. 20 (with the triangular planar element 114 not shown) but wherein the balanced antenna 132 is constituted by a printed dipole having a central substantially T-shaped cut-out 134 separating each arm 136 of the dipole and a small rectangular cut-out 138 at the extreme end of each arm 136, adjacent the edge 140 of the rectangular planar element 116. There is also no cut-out in the rectangular planar element 116. It will be noted that the distance between the balanced antenna 132 and the rectangular planar element 116 will directly affect the efficiency of the antenna 130. Thus, the balanced antenna 132 is supported at an appropriate distance above the rectangular planar element 116 by Rohacell™ foam or the like (not shown).

Figure 22:
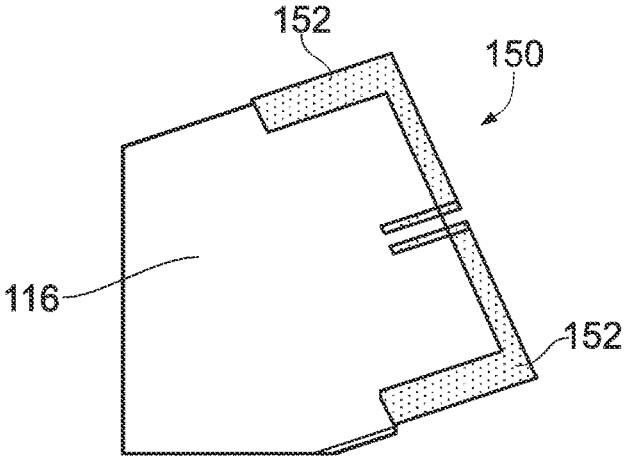
FIG. 22 shows a partial top side perspective view of an antenna similar to that shown in FIG. 20 but wherein the balanced antenna comprises an L-shaped printed dipole.

FIG. 22 shows a partial top side perspective view of an antenna similar to that shown in FIG. 20 (with the triangular planar element 114 not shown) but wherein the balanced antenna 150 is constituted by an L-shaped printed dipole such that the arms 152 are no longer bracket-shaped but are instead mounted above the rectangular planar element 116 by foam supports or the like (not shown).

Figure 23:
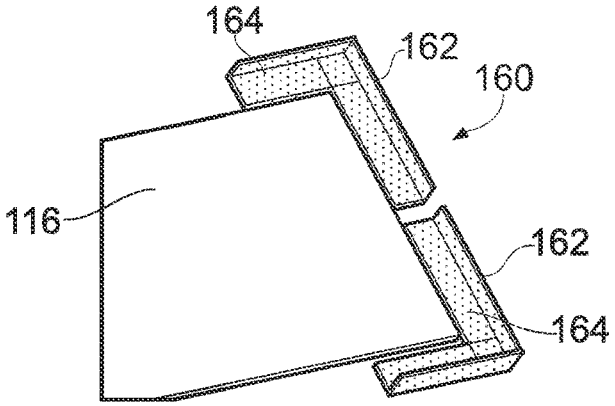
FIG. 23 shows a partial top side perspective view of an antenna similar to that shown in FIG. 20 but wherein the balanced antenna is provided around the outside of the substrate.

FIG. 23 shows a partial top side perspective view of an antenna similar to that shown in FIG. 20 (with the triangular planar element 114 not shown) but wherein the balanced antenna 160 is provided around the outside of the rectangular planar element 116, the bracket portions 162 of each L-shaped arm 164 are inverted and there is no cut-out provided in the rectangular planar element 116. As per FIGS. 20 to 22, the balanced antenna 160 is mounted to the rectangular planar element 116 by foam supports or the like (not shown).

Figure 24A:
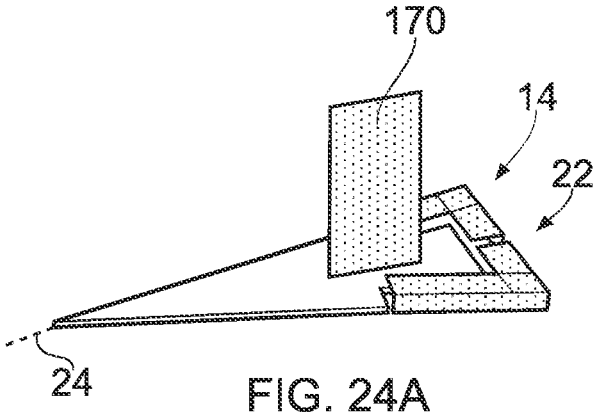
FIG. 24A shows a top side perspective view of an antenna similar to that shown in FIG. 8A.
Figure 24B:
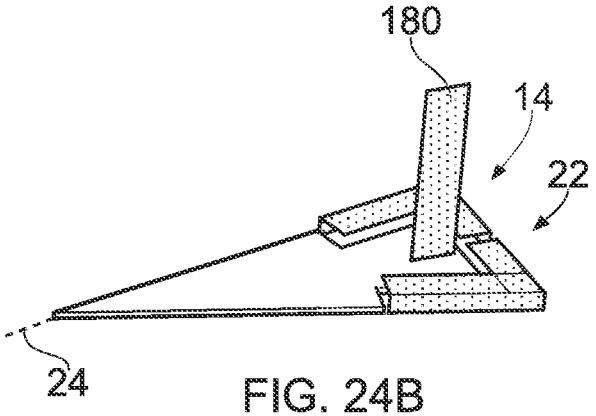
FIG. 24B shows a top side perspective view of an antenna similar to that shown in FIG. 24A but with a narrower unbalanced antenna element.
Figure 24C:
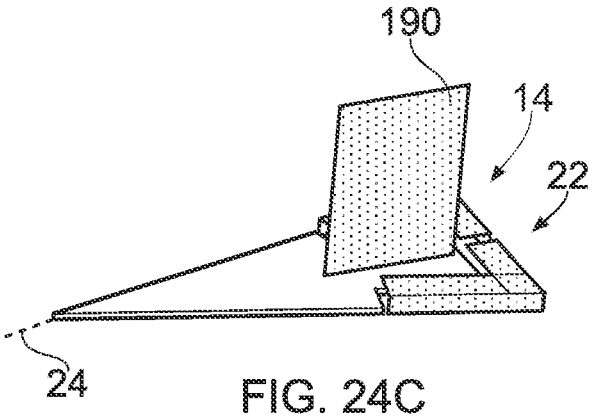
FIG. 24C shows a top side perspective view of an antenna similar to that shown in FIG. 24A but with a wider unbalanced antenna element.

FIGS. 24A, 24B and 24C show a range of different sizes and locations for the non-resonant rectangular copper plate 64 of the unbalanced antenna 62 shown in FIGS. 8A and 8B. In FIG. 24A, a plate 170 is shown with a width similar to the width of the balanced antenna 14 but wherein the plate 170 is positioned on the central axis 24 such that it is only partially enclosed by the balanced antenna 14. In FIG. 24B, a plate 180 is shown with a width of approximately half the width of the balanced antenna 14 and the plate 180 is positioned on the central axis 24 next to the end 22. In FIG. 24C, a plate 190 is shown with a width of approximately one and a half times the width of the balanced antenna 14 and the plate 180 is positioned on the central axis 24 next to the end 22.

According to the above, embodiments of the present invention provide a reconfigurable MIMO antenna which is suitable for use a roof-mounted vehicle antenna and is able to cover multiple services such as DVB-H, GSM710, GSM850, GSM900, GSM1800, PCS1900, GPS1575, UMTS2100, Wifi, Bluetooth, LTE, LTA and 4G frequency bands.

It will be appreciated by persons skilled in the art that various modifications may be made to the above-described embodiments without departing from the scope of the present invention. In particular, features described in relation to one embodiment may be incorporated into other embodiments also.

The invention claimed is:

1. A reconfigurable MIMO (Multiple-Input Multiple-Output) antenna for vehicles, comprising:

a balanced antenna and an unbalanced antenna, wherein the unbalanced antenna is mounted on a supporting substrate having an end, wherein both the balanced antenna and the unbalanced antenna are located substantially at the end of the substrate, wherein the substrate comprises a substantially triangular planar element, wherein the end of the substrate comprises a base of the substantially triangular planar element, wherein the unbalanced antenna is substantially planar, and wherein the unbalanced antenna is mounted on the supporting substrate such that it extends substantially perpendicularly to the substantially triangular planar element.

2. The antenna according to claim 1, wherein the unbalanced antenna is provided on a second substrate extending substantially perpendicularly to the substantially triangular planar element, wherein the second substrate is in the shape of a quarter-ellipse having a curved top surface and a perpendicular end surface, which is located substantially at the end of the substrate.

3. The antenna according to claim 1, wherein the substantially triangular planar element further comprises two sides which are substantially equal in length.

4. The antenna according to claim 1, wherein the substrate further comprises a substantially rectangular planar element located adjacent the base of the substantially triangular planar element.

5. The antenna according to claim 1, wherein the balanced antenna comprises two symmetrically arranged arms, wherein each arm comprises a respective L-shaped planar element that faces inwardly towards the other arm.

6. The antenna according to claim 5, wherein the balanced antenna is constituted by a printed dipole.

7. The antenna according to claim 5, wherein the L-shaped planar elements conform to a shape of the substrate.

8. The antenna according to claim 5, wherein the substrate further comprises a substantially rectangular planar element located adjacent the base of the substantially triangular planar element, wherein the balanced antenna is provided on the substantially rectangular planar element, and wherein the L-shaped planar elements each have an internal angle of 90 degrees.

9. The antenna according to claim 5, wherein the balanced antenna is provided on the substantially triangular planar element and the L-shaped planar elements each have an internal angle of less than 90 degrees.

10. The antenna according to claim 1, wherein at least one of the balanced antenna or the unbalanced antenna is non-resonant, wherein the unbalanced antenna comprises a non-resonant element that is fed against a ground plane, and wherein the balanced antenna is fed against itself.

11. The antenna according to claim 1, further comprising one or more matching circuits arranged to tune one or more of the balanced antenna or the unbalanced antenna to an operating frequency and configured to cover one or more of: DVB-H, GSM710, GSM850, GSM900, GSM1800, PCS1900, SDARS, GPS1575, UMTS2100, Wifi, Bluetooth, LTE, LTA, or 4G frequency bands.

12. The antenna according to claim 11, wherein different modes of operation are available by selecting different matching circuits for at least one of the balanced antenna or the unbalanced antenna, and switches are provided to select the matching circuits for a particular mode of operation.

13. The antenna according to claim 11, wherein each matching circuit comprises at least one variable capacitor to tune a frequency of the associated balanced antenna or unbalanced antenna over a particular frequency range, and wherein the at least one variable capacitor is constituted by multiple fixed capacitors with switches, a varactor or a MEMs capacitor.

14. The antenna according to claim 11, wherein the matching circuits associated with the unbalanced antenna are coupled to a first signal port, wherein the matching circuits associated with the balanced antenna are coupled to a second signal port, and wherein at least one of each signal port or each matching circuit is associated with a different polarisation.

15. The antenna according to claim 14, further comprising a control system that is connected to each port and that is configured to select an operating mode.

16. The antenna according to claim 1, wherein the unbalanced antenna is located adjacent to, at least partially enclosed by, within a footprint of, or transversely aligned with at least a portion of the balanced antenna.

17. The antenna according to claim 1, wherein the unbalanced antenna comprises at least a portion which is etched onto the substrate.

18. The antenna according to claim 1, wherein the unbalanced antenna comprises at least a portion that is provided on a separate structure attached to the substrate.

19. The antenna according to claim 1, wherein the balanced antenna is located substantially at the end, and around an outside, of the substrate.

20. The antenna according to claim 1, wherein the balanced antenna and the unbalanced antenna are provided on opposite surfaces of the substrate, and wherein the balanced antenna and the unbalanced antenna are transversely separated by a thickness of the substrate alone.

21. The antenna according to claim 1, wherein the substrate has a ground plane printed on a first surface thereof and the unbalanced antenna is also provided on the first surface, wherein the unbalanced antenna and is separated from the ground plane by a gap.

22. A vehicle comprising:

a reconfigurable MIMO (Multiple-Input Multiple-Output) antenna, comprising:

a balanced antenna; and an unbalanced antenna mounted on a supporting substrate having an end, wherein both the balanced antenna and the unbalanced antenna are located substantially at the end of the substrate, wherein the substrate comprises a substantially triangular planar element, wherein the end of the substrate comprises a base of the substantially triangular planar element, wherein the unbalanced antenna is substantially planar, and wherein the unbalanced antenna is mounted on the supporting substrate such that it extends substantially perpendicularly to the substantially triangular planar element.

* * * * *